US005370469A

United States Patent [19]

Mutou et al.

[11] Patent Number: 5,370,469

[45] Date of Patent: Dec. 6, 1994

[54] CASSETTE HOLDER ASSEMBLY

[75] Inventors: Eisaku Mutou; Minoru Mizutani; Norihisa Isaka, all of Tokyo, Japan

[73] Assignee: Oki Electric Industry Co., Ltd., Tokyo, Japan

[21] Appl. No.: 79,548

[22] Filed: Jun. 22, 1993

[30] Foreign Application Priority Data

Jul. 1, 1992 [JP] Japan ..... 4-045858
Jul. 1, 1992 [JP] Japan ..... 4-174202

[51] Int. Cl.[5] ..... B41J 35/00

[52] U.S. Cl. ..... 400/206; 400/208; 400/211; 400/216.1; 400/352

[58] Field of Search ..... 400/206, 208, 211, 212, 400/216.1, 216.2, 216.3, 216.4, 216.5, 217, 217.1, 352, 353, 355, 357, 191, 82, 175, 206.1, 206.2, 214, 692, 216

[56] References Cited

U.S. PATENT DOCUMENTS 4,694,305 9/1987 Shiomi et al. ..... 400/216.1 X
4,697,942 10/1987 Yagi et al. ..... 400/208
4,773,776 9/1988 Gomoll et al. ..... 400/208
4,867,587 9/1989 Kishida et al. ..... 400/216.1 X
5,160,204 11/1992 Naito et al. ..... 400/208

FOREIGN PATENT DOCUMENTS 0005090 1/1984 Japan ..... 400/214
0031283 2/1986 Japan ..... 400/214
0054976 3/1986 Japan ..... 400/214
0049475 3/1988 Japan ..... 400/82

*Primary Examiner*—Edgar S. Burr
*Assistant Examiner*—Christopher A. Bennett
*Attorney, Agent, or Firm*—Steven M. Rabin

[57] ABSTRACT

A cassette holder assembly includes a first cassette holder for detachably attaching a first ink ribbon cassette at a position that the ink ribbon is supplied to a printing face of a print head, and a second cassette holder detachably mounted on the first cassette holder when the first ink ribbon cassette is detached from the first cassette holder and provided with a ribbon shifting mechanism for shifting the ink ribbon of a second ink ribbon cassette with respect to the printing face of the print head. In accordance, the cassette holders can be replaced easily by an operator, and the printer can be used effectively.

17 Claims, 9 Drawing Sheets

CASSETTE HOLDER ASSEMBLY

BACKGROUND OF THE INVENTION

1. Field of the Invention

This invention relates to a cassette holder assembly for detachably attaching an ink ribbon cassette thereto, mounted on a carriage or of impact printer.

2. Description of Related Art

An ink ribbon cassette used for an impact printer is held by a cassette holder which is mounted together with a print head on a carriage of the printer and holds an ink ribbon in opposition to a tip side face, or a printing face of the print head. Ink ribbons are generally classified into two types, namely, monochrome ink ribbon, as first ink ribbon, and multicolor ink ribbons, as second ink ribbons, which are respectively composed of a plurality of color ribbons. Cassettes for the ink ribbons are held by cassette holders only for each type. The cassette holder for the monochrome ink ribbon holds the cassette at a position for supplying the ink ribbon to the printing face of the print head. The cassette holder for the multicolor ink ribbon is equipped with a mechanism for shifting the position of the ribbon, and holds the cassette so that a feeding mechanism properly feeds the ribbon of each color to the printing face of the head.

Such a cassette holder is fixedly mounted on the carriage, and replacement of the cassette holder requires a service engineer to work on it, because the replacement involves delicate work. Moreover, users of such a printer usually buy either one of printers for monochrome ink ribbon and for multicolor ink ribbon, or both. Although some cassette holder enables the user to replace it so as to meet with types of the ink ribbon by himself or herself, the cassette holder still raises a problem in laborious replacement of the cassette holder.

In the mechanism for shifting of the ribbon, the back of the cassette is supported so as to be rotatable by the cassette holder, and a cam gear is rotated by a motor incorporated in the cassette holder. A push rod, one end of which is contacted to the cam gear, is moved up and down, so that the cassette contacting the other end of the push rod is swung to feed each color ribbon to the printing face of the print head. Consequently, the shifting mechanism must be provided with a pushrod having a length corresponding to the shift stroke or a thick cam gear, and therefore, the shifting mechanism becomes thick in a vertical direction as a whole, thereby affecting the thickness of the printer.

SUMMARY OF THE INVENTION

It is an object of the invention to provide a cassette holder assembly for interchangeably holding a monochrome ink ribbon and a multicolor ink ribbon without replacing the cassette holder.

It is another object of the invention to provide a cassette holder assembly having a ribbon shifting mechanism formed in a thin size in a vertical direction.

The foregoing objects are accomplished with a cassette holder assembly including a first cassette holder, mounted on a carriage capable of moving for spacing, for detachably attaching a first ink ribbon cassette to a position thereof at which the ink ribbon in the first ink ribbon cassette is opposed to a printing face of a print head of a printer, and a second cassette holder detachably attached on the first cassette holder when no first ink ribbon cassette is attached to the first cassette holder and provided with a ribbon shifting mechanism for shifting the ink ribbon of a second ink ribbon cassette with respect to the printing face of the print head.

In the cassette holder assembly, the first cassette holder is mounted on the carriage, and the second cassette holder is mounted on the first cassette holder. When a monochrome ink ribbon is used, a monochrome ink ribbon cassette as of the first ink ribbon cassette is detachably attached to the first cassette holder, and when a multicolor ink ribbon is used, a multicolor ink ribbon cassette as of the second ink ribbon cassette is detachably attached to the second cassette holder where the monochrome ink ribbon cassette is detached from the first cassette holder. Accordingly, user can attach the monochrome ink ribbon and the multicolor ink ribbon interchangeably.

In another aspect of the invention, the second cassette holder includes a fixed holder mounted on one face of a body of the first cassette holder, having a plurality of first latch members for engaging corresponding positions of side walls of the body of the first cassette holder, a liftable holder for detachably attaching a multicolor ink ribbon cassette, having a plurality of second latch members for engaging the multicolor ink ribbon cassette, and a ribbon shifting mechanism, having a thread pair for moving the liftable holder to move the liftable holder in the up and down direction in parallel with respect to the fixed holder, for shifting the ink ribbon of the multicolor ink ribbon cassette with respect to the printing face of the print head.

Since the liftable holder detachably attaching the multicolor ink ribbon cassette can be moved in parallel in the up and down direction with respect to the fixed holder by the ribbon shifting mechanism through a pair of the threads of the liftable holder and the ribbon shifting mechanism, the ribbon shifting mechanism can be formed in a thin size in a vertical direction.

BRIEF DESCRIPTION OF THE DRAWINGS

The above and other objects and features of the invention are apparent to those skilled in the art from the following preferred embodiments thereof when considered in conjunction with the accompanied drawings, in which:

FIGS. 2A to 2C are perspective views, showing portions of the cassette holder assembly in FIG. 1, in which, FIG. 2A is showing a second cassette holder, FIG. 2B shows a first cassette holder, and FIG. 2C shows a printed board for a spacing motor;

DETAILED DESCRIPTION OF THE PREFERRED EMBODIMENTS

Figure 1:
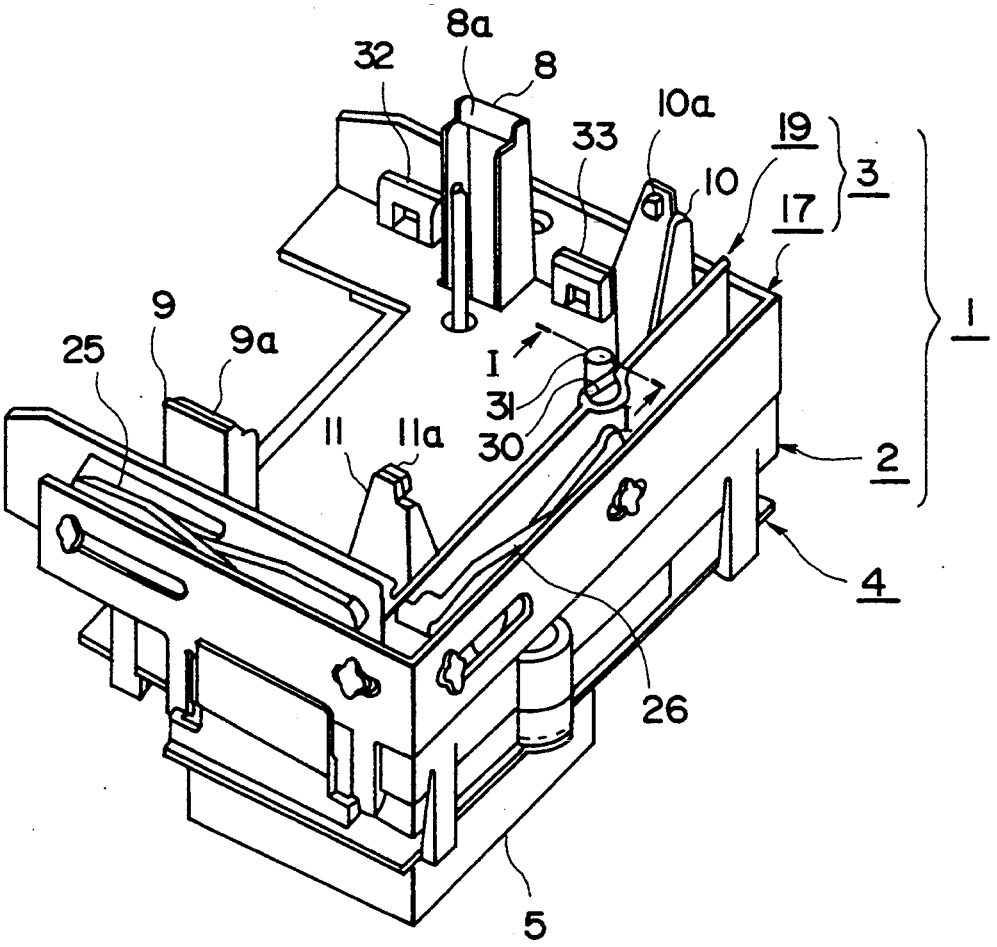
FIG. 1 is a perspective view showing a cassette holder assembly according to a preferred embodiment of the invention.

Referring to the drawings in detail, in particular, to FIG. 1, a cassette holder assembly for an impact printer according to a preferred embodiment of the invention is shown. The cassette holder assembly 1 is composed of a first cassette holder 2 and a second cassette holder 3. The first cassette holder 2 is detachably attached to a printed board 4 for a spacing motor, and when an ink ribbon cassette is removed from the first cassette holder 2, the second cassette holder 3 can be detachably attached to the first cassette holder 2.

Figure 2A:
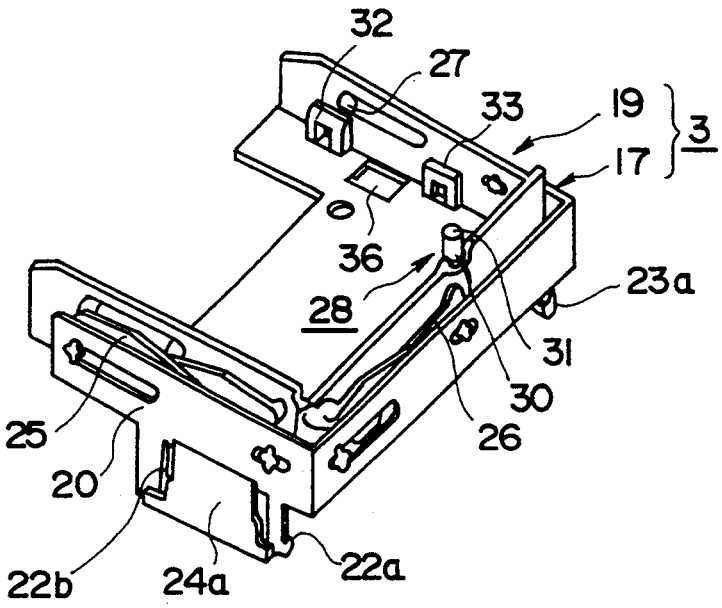
Figure 2B:
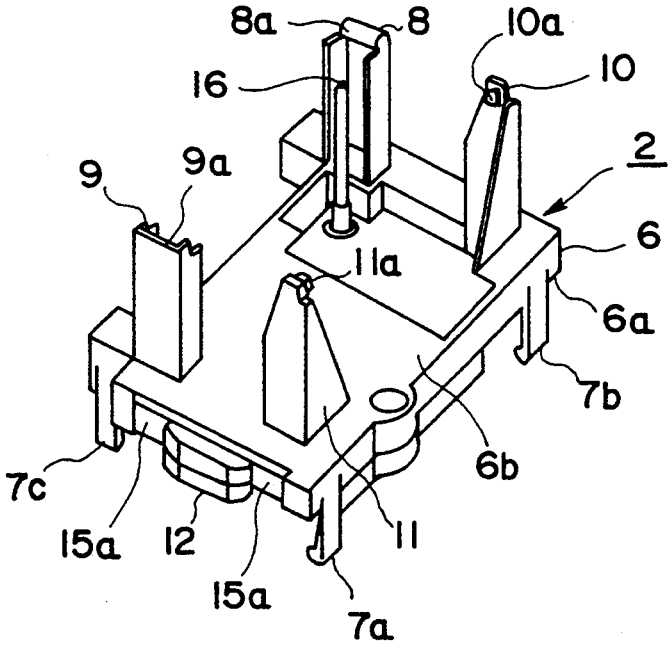
Figure 2C:
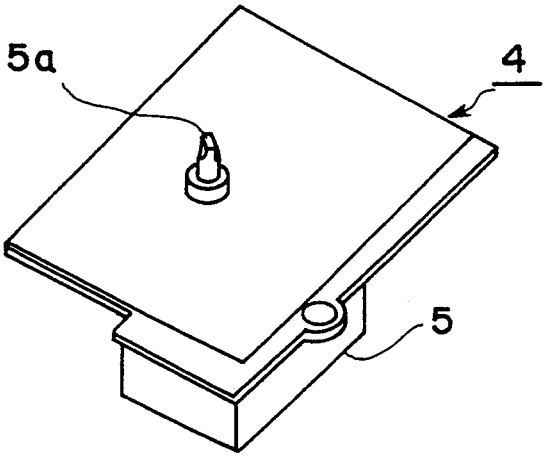
Figure 3:
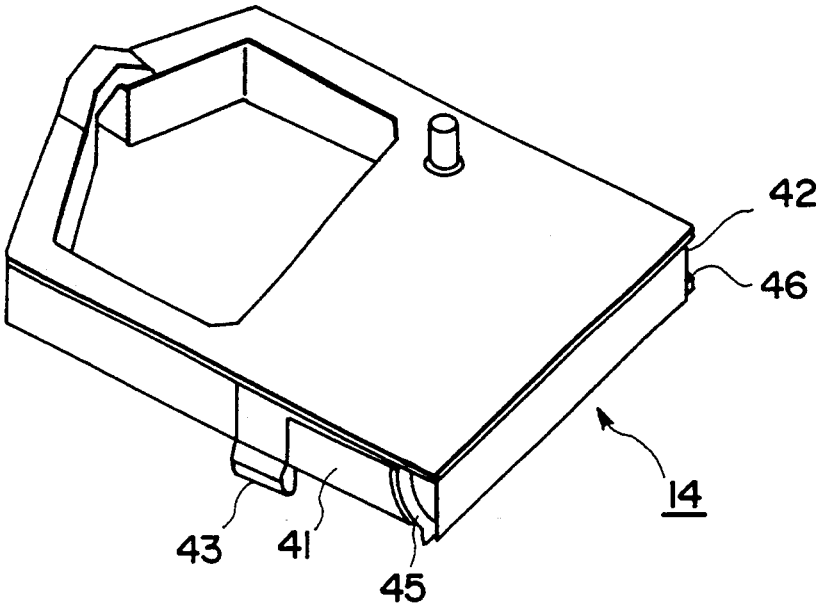
FIG. 3 is a perspective view showing a monochrome ink ribbon cassette, as a first ink ribbon cassette, mounted on the first cassette holder of FIG. 2B.

FIGS. 2A to 2C are exploded perspective views of the cassette holder assembly. FIG. 2A is a perspective view showing a second cassette holder; FIG. 2B is a perspective view showing a first cassette holder; FIG. 2C is a perspective view showing a printed board for a spacing motor. FIG. 3 is a perspective view showing a monochrome ink ribbon cassette, as a first ink ribbon cassette, to be mounted on the first cassette holder, and FIG. 4 is a perspective view showing a multicolor ink ribbon cassette, as a second ink ribbon cassette, to be mounted on the second cassette holder.

The printed board 4 for a spacing motor is mounted on a carriage not shown. The spacing motor, not shown, mounted on the printed board 4 moves the carriage for spacing operation with respect to the printing surface not shown and also rotates a motor shaft 5*a*.

As shown in FIG. 2B, the first cassette holder 2 includes a body 6 having one face 6*a* mounted on the printed board 4 for the spacing motor and the other face 6*b* on which the second cassette is mounted, a plurality of cassette supporters 8 to 11 extending perpendicularly from the other face 6*b* of the body 6, and a plurality of flexible snap tongues 7*a* to 7*d* (7*d* is not shown) perpendicularly extending from the one face 6*a* of the body 6 and having hooks for engaging the printed board 4 at their top. The cassette supporters 8 to 11 detachably attach the first ink ribbon cassette 14 shown in FIG. 3 and oppose to the printing face of the print head. Projections 8*a*, 9*a* facing each other are provided at tips of the cassette supporters 8, 9, and hemispheric projections 10*a*, 11*a* facing each other are provided at tips of the cassette supporters 10, 11. Projections 12, 13 (13 is not shown) serving as fulcrums of levers when the engaged second cassette holder 3 is ejected are disposed on opposite side walls 15*a*, 15*b* (15*b* is not shown) of the body 6. A mechanism, not shown, engaged with the motor shaft 5*a* of the printed board 4 for the spacing motor is incorporated inside of the body 6. In engagement with the mechanism, a ribbon shaft 16 for rotating the ink ribbon of the first ink ribbon cassette 14 within the cassette is provided so as to extend perpendicularly from the holder 2.

Figure 4:
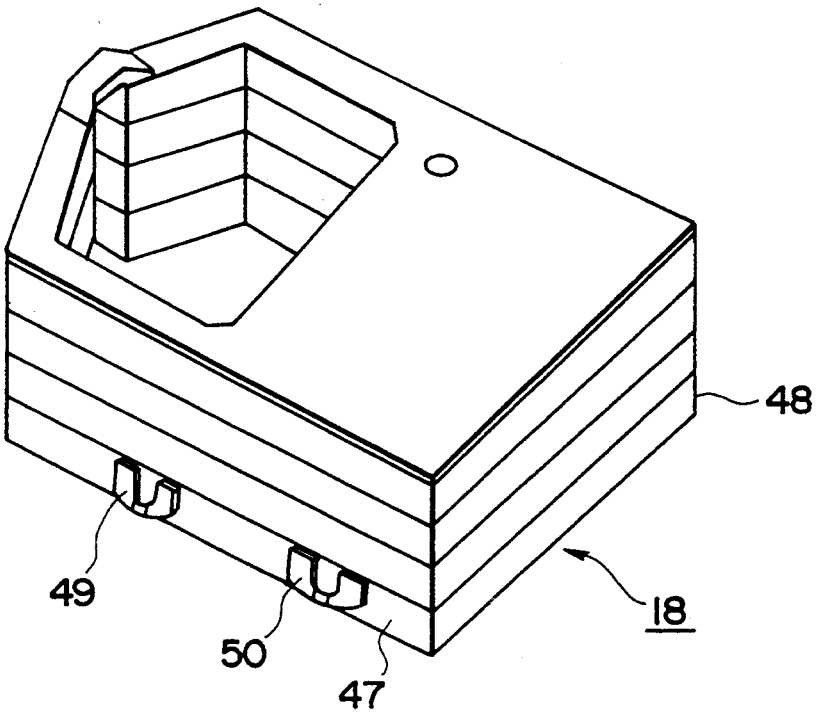
FIG. 4 is a perspective view showing a multicolor ink ribbon cassette, as a second ink ribbon cassette, mounted on the second cassette holder of FIG. 2A.
Figure 5:
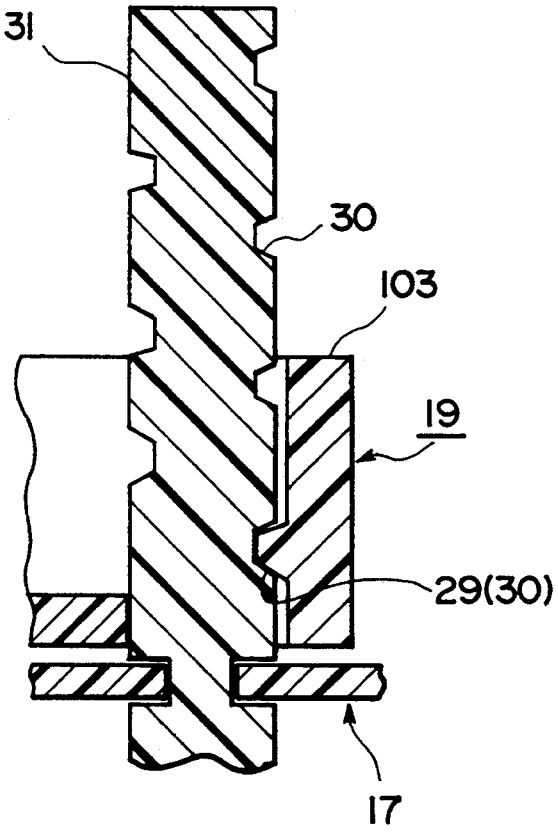
FIG. 5 is a cross section taken along line I—I of FIG. 1.

The second cassette holder 3 includes, as shown in FIG. 2A, a fixed holder 17 detachably attached to the body 6 of the first cassette holder 2, a liftable holder 19 detachably supporting the second ribbon cassette 18 shown in FIG. 4 and positioning the second ribbon cassette 18 to occupy the same space as would otherwise be occupied by the first ribbon cassette 14 if the latter were attached, so as to oppose the printing face of the print head by up and down movement thereof, and a ribbon shifting mechanism as described below. The ribbon shifting mechanism includes parallel link mechanisms 25, 26, 27, between side walls of the holders 17 and 18 a shift mechanism 28, and, as described below, a rotation mechanism and a control unit. The shift mechanism 28, as shown in FIG. 5, includes a projection 29 provided at the liftable holder 19, and a cam shaft 31 having a helical groove 30 engaging the projection 29.

First latch members 22*a*, 22*b* and 22*c*, 22*d* for respectively engaging side walls 15*a*, 15*b*, and which sandwich the projections 12, 13 of the first cassette holder 2 therebetween, are respectively provided at mutually opposing side walls 20, 21 of the fixed holder 17, wherein the numerals 22*c*, 22*d*, 15*b*, 21 are not shown. The liftable holder 19 moves up and down with respect to the fixed holder 17 by the operation of the ribbon shifting mechanism using a pair of threads. Second latch members 32 to 35 (the numerals 34, 35 not shown) are provided on the liftable holder 19, for detachably attaching the second ribbon cassette 18. Through holes 36 to 39 (the numerals 37 to 39 not shown), corresponding to the cassette supporters 8 to 11 of the first cassette holder 2, are formed at the fixed holder 17 and the liftable holder 19.

The first ribbon cassette 14 is exemplified as for a black ink ribbon as shown in FIG. 3. Provided on opposite side walls 41, 42 of the first ribbon cassette 14 are projections 43, 44 (the numeral 44 not shown) oriented outward for engaging the projections 8*a*, 9*a* of the cassette supporters 8, 9, respectively, and guide portions 45, 46 to engage with the hemispheric projections 10*a*, 11*a* of the cassette supporters 10, 11 to guide them.

The second ribbon cassette 18 is exemplified as for a multicolor ink ribbon as shown in FIG. 4. Provided on side walls 47, 48 are latch portions 49 to 52 (the numerals 51, 52, not shown) for engaging the second latch members 32 to 35 of the second cassette holder 3 shown in FIG. 2A. The multicolor ink ribbon is composed of four colors, namely, black, as a top layer of the second ribbon cassette 18, and cyan, magenta, and yellow in the downward order.

Figure 6:
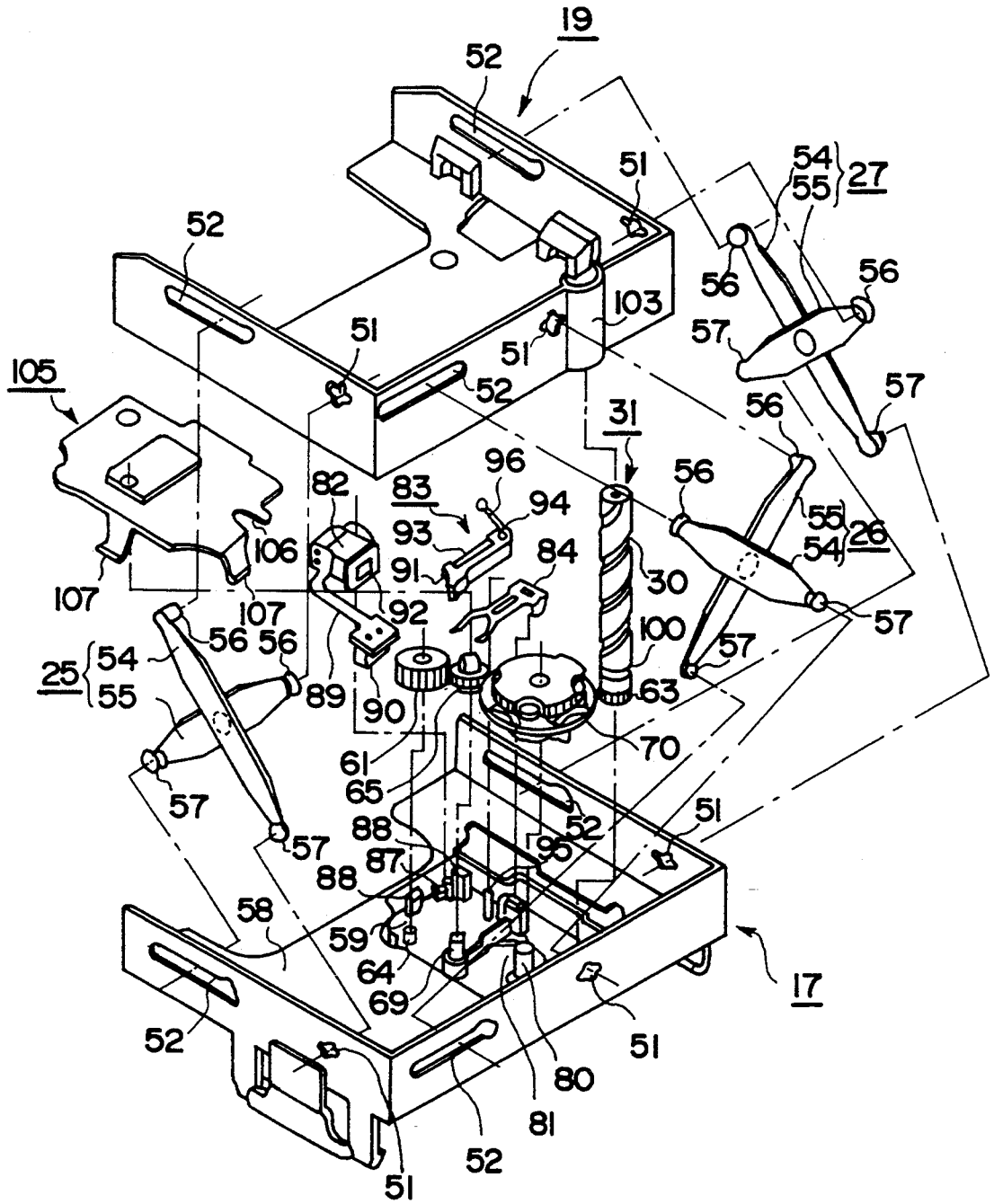
FIG. 6 is an exploded perspective view showing the second cassette holder of FIG. 2A.
Figure 7:
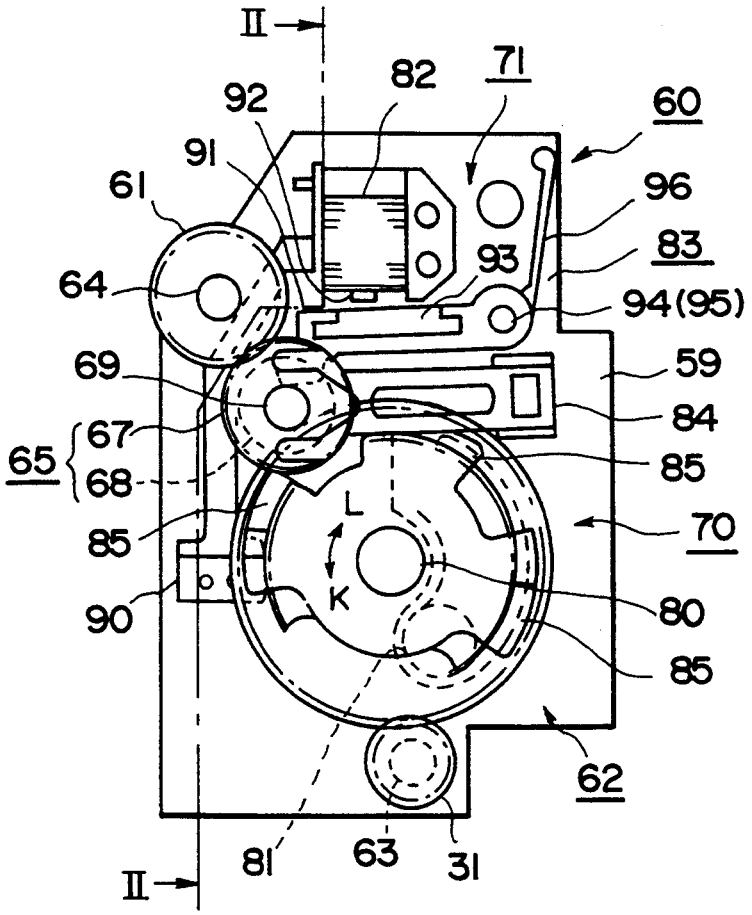
FIG. 7 is a plan view showing a rotation mechanism and a shifting mechanism of the cassette holder assembly according to the invention.
Figure 8:
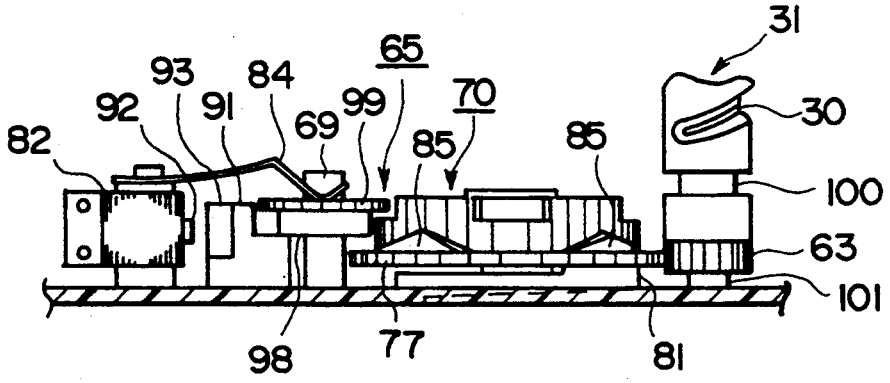
FIG. 8 is a cross section taken along line II—II of FIG. 7.
Figure 9A:
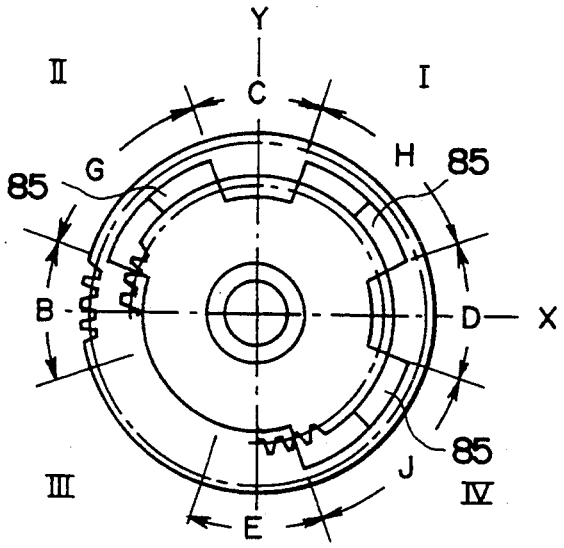
FIGS. 9A to 9C are a top view, a plan view, and a bottom view, respectively, showing a cam gear of the cassette holder assembly according to the invention.
Figure 9B:
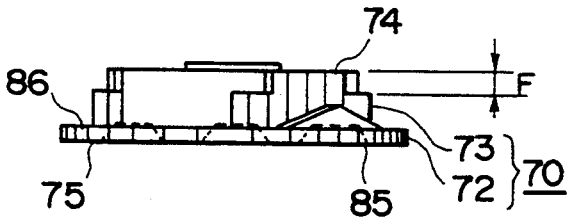
Figure 9C:
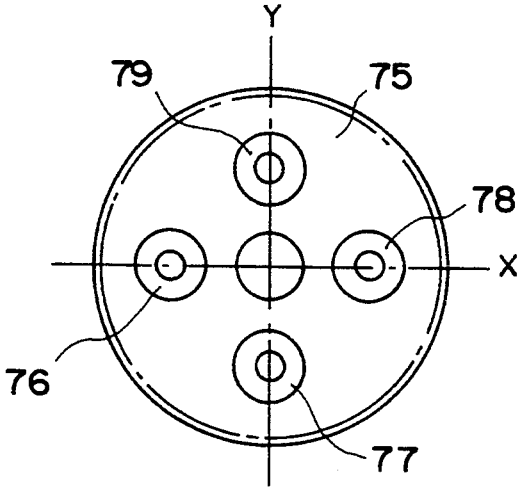
Figure 10:
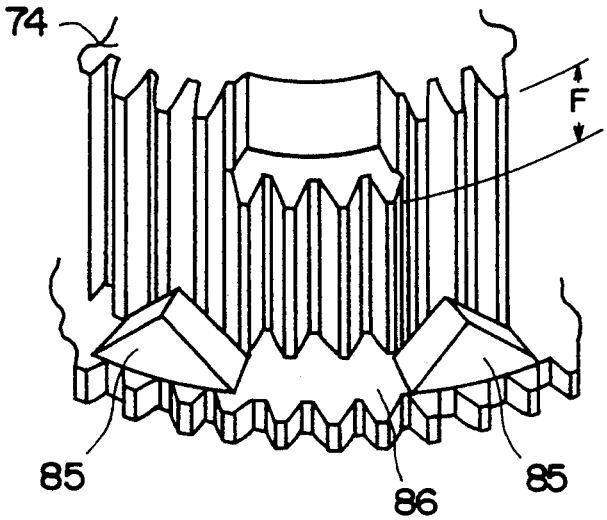
FIG. 10 is a partially enlarged view of the cam gear of FIGS. 9A to 9C.

FIG. 6 is an exploded perspective view showing the second cassette holder; FIG. 7 is a plan view showing a rotation mechanism and a shifting mechanism; FIG. 8 is a cross section taken along line II—II of FIG. 7; FIGS. 9A to 9C are a top view, a plan view, and a bottom view, respectively, showing a cam gear; FIG. 10 is a partial enlarged view of the cam gear.

The fixed holder 17 and the liftable holder 19, both are formed in a box with one side wall broken away, as shown in FIG. 6, and each holder includes on the three side walls 20 thereof, a cross hole 51, and a long hole. The parallel link mechanisms 25, 26, 27 are respectively constituted of a link 54 and a link 55, which are pivotably connected with each other through their centers so as to rotate around their centers. Projections 56, 57, one set of which is projected toward a direction opposite to that of the other set, are provided at the ends of the links 54, 55, respectively. The projections 56, 57 of the parallel link mechanisms 25, 26 and 27 are fitted into the holes 51 and the long holes 52, and when folded, the parallel link mechanisms 25, 26, 27 are contained between the side walls of the fixed holder and the liftable holder.

A recess portion 59 is formed at a part of a bottom 58 of the fixed holder 17 as shown in FIG. 7. An essential portion of a rotation mechanism 60 is contained in the recess portion 59. The rotation mechanism 60 is constituted of a drive gear 61 which rotates based on a spacing operation, an intermittent rotator 62 stopping after every rotation for one shift operation for the cassette, and a gear 63 as a first gear rotating together with the cam shaft 31, which has the thread formed by the groove 30 engaging the thread formed by the projection 29 of the liftable holder 19. The drive gear 61 is rotatably mounted on a shaft 64 extending perpendicularly from the bottom 58 at the recess portion 59 as shown in FIG. 6, and is partially protruded from the side wall, thereby engaging a not shown gear located in the body 6 of the first cassette holder 2 shown in FIG. 2B. A change gear 65 as a second gear is formed in a stepped shape from a large disc 67 and a small disc 68, as shown in FIGS. 7, 8. Gear teeth for meshing the drive gear 61 are formed at the circumference of the large disc 67. The drive gear 61 has teeth whose thickness is enough to keep the engagement even if the change gear 65 slidably moves along the shaft 69.

The intermittent rotator 62 is composed of a unitary gear member as cam gear 70 and a clutch portion 71. The cam gear 70 is formed in a stepped shape and has a large disc 72 as a fourth gear and a small gear 73 as a third gear as shown in FIG. 9B, whose circumferences have gear teeth meshing the cam shaft 31 and the change gear 65, respectively. The small disc 73 has toothless or partial tooth portions on the face of the gear teeth thereof. Referring to FIG. 9A, 9B, and 9C, a positional relationship between such toothless or partial tooth portions and the color ribbon will be described using X and Y axes and quadrants. Concerning four quadrants divided by X and Y axes in FIG. 9A, the first to the forth quadrants are assigned counterclockwise from the upper right quadrant. Ranges indicated by numerals B, C, D, E, extending fanwise astride two quadrants with respect to X or Y axis as a center line, are partial tooth portions B, C, D, E, in which a no tooth area extending fanwise is formed to a depth F from the level of a side face 74. In the third quadrant, the reminder of ranges is a perfectly no tooth portion, that is a toothless portion, which does not have any teeth.

On the other hand, provided on a side face 75 of the large disc 72 are dimples 76, 77, 78, 79 for positioning corresponding to the partial tooth portions B, C, D, E, as shown in FIG. 9C. In this embodiment, the partial tooth portions B, C, D, E correspond to black, cyan, magenta, yellow of the multicolor ribbon, respectively. The cam gear 70 is rotatably mounted on a shaft 80 extending perpendicularly from the bottom of the recess portion 59 so that the large disc is located on a lower side, and when the cam gear 70 is rotated as shown in FIG. 7, a detent spring 81 formed in a unitary body with the bottom of the recess portion 59 engages with one the dimples 76 to 79 on the side face 75 so as to push up the cam gear 70.

Provided on a side face 86 of the large disc 72 are angle bosses 85 as a slantly leading mechanism. The angle bosses 85 provided on the side face 86 of the large disc 72 are extending across fan shaped ranges G, H, J, respectively, between the partial tooth portions B, C, D, E, as shown in FIG. 10. As shown in FIGS. 6, 8–10 and 12, the ranges G,H,J are complete tooth portions in which the teeth extend from the thread face 86 to the side face 74.

The clutch portion 71 is constituted of an electromagnet 82, a reset spring 83 as a second spring member, and a set spring 84 as a first spring member. The electromagnet 82 is secured by a boss 87 and a hook 88 arranged at a bottom of the recess portion 59, and is connected through a connector 90 connected to a flexible cable 89 to another not shown connector on a carriage's side through a hole formed at a bottom of the recess portion 59. The reset spring 83 is formed in an L-shape and disposed so as to surround the electromagnet 82 as shown in FIG. 7. The reset spring 83 is molded with synthetic resin or the like. One arm 91 of the reset spring 83 supports an armature 93 located in opposition to a core 92 of the electromagnet 82, and the other arm 96 contacts to a side wall of the recess portion 59, while a center hole 94 of the reset spring 83 is rotatably arranged on a shaft 95, which extends perpendicularly from the bottom of the recess portion 59. Accordingly, the one arm 91 is urged so as to separate from the core 92 of the electromagnet 82, and enters below the change gear 65, thereby supporting the side face 98. The set spring 84 is a plate spring and, as shown in FIG. 8, pushes the side face 99 of the change gear 65 down. That is, the change gear 65 is sandwiched between the reset spring 83 and the set spring 84.

The cam shaft 31 is cylindrical as shown in FIGS. 7, 8. The circumferential face of the cam shaft 31 has the helical groove 30, a groove 100, and a gear 63 in this order from the top thereof. The helical groove 30 engages with the projection 29 arranged at an engaging portion 103 of the liftable holder 19 so as to form the thread pair 29, 30 as shown in FIGS. 5, 6. The gear 63 is rotatably mounted on a shaft 101 extending perpendicularly from the recess portion 59 as shown in FIG. 8.

A cover plate 105 covers the recess portion 59 of the fixed holder 17 after a U-shaped groove 106 of a cover plate 105 is inserted into the groove 100 of the cam shaft 31, and snap pieces 107 are fitted to corresponding holes of the fixed holder 17. This arrangement prevents the drive gear 61 and the cam gear 70 from floating from their shafts 64, 82, respectively, and makes the cam shaft 31 to extend perpendicularly with respect the fixed holder 17.

Figure 11:
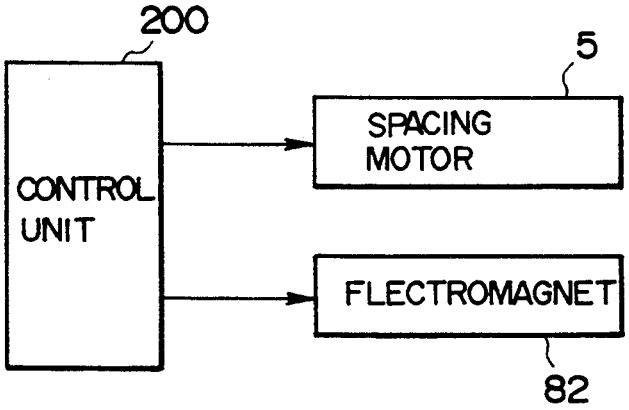
FIG. 11 is a block diagram illustrating a control unit of the cassette holder assembly according to the invention.
Figure 12:
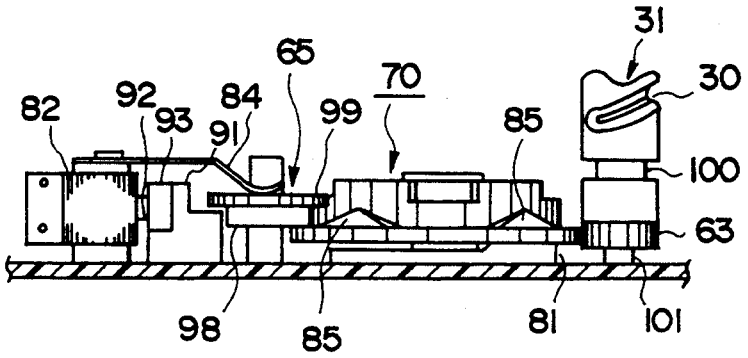
FIG. 12 is a cross section, taken along line II—II of FIG. 7, of the cassette holder assembly at a time that the electromagnet is excited.
Figure 13:
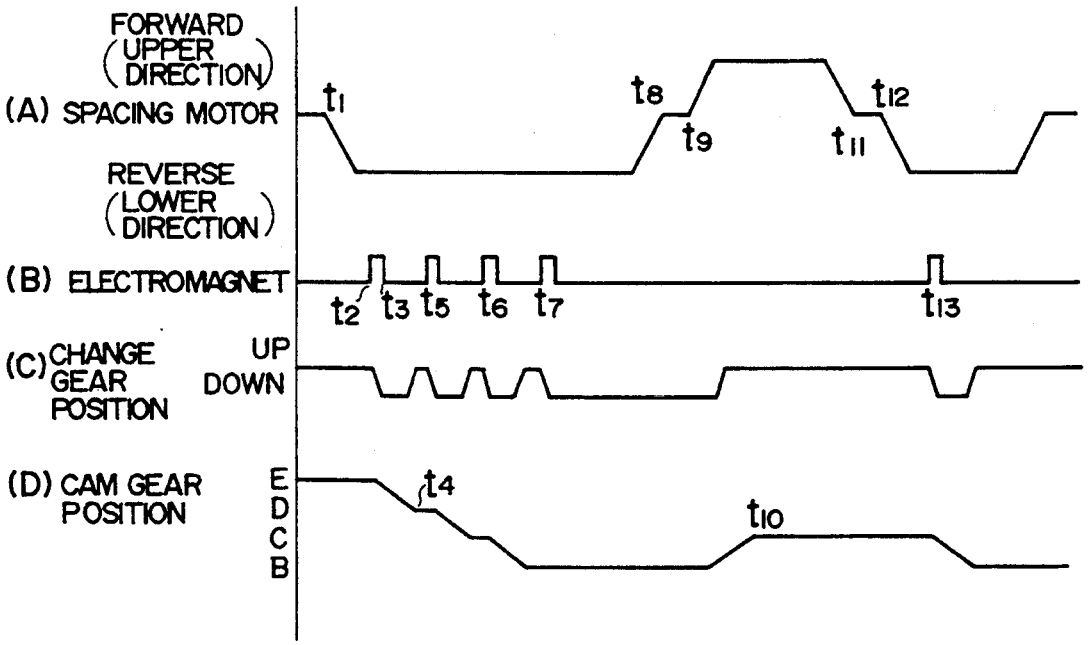
FIG. 13 is a time chart showing a homing operation of the cassette holder assembly according to the invention

FIG. 11 is a block diagram of the control system according to the invention. A control unit 200 composed of a microprocessor is connected to the spacing motor 5 and the electromagnet 82. FIG. 12 is a cross section, taken along line II—II of FIG. 7, showing conditions at a time that the electromagnet is excited. FIG. 13 is a time chart showing a homing operation. The homing operation is defined as an initial positioning movement for the multicolor ribbon, and particularly, in this embodiment, a color ribbon (Black) provided at the top layer shown in FIG. 4 is positioned to the printing face of the print head. The numerals (A), (B), (C), and (D) represent operations of the spacing motor, the electromagnet, the change gear, and the cam gear, respectively.

In operation, when printing is performed using the monochrome ink ribbon, the first ribbon cassette 14 is set to the cassette supporters 8 to 11 of the first cassette holder 2. That is, the hemispheric projections 10*a*, 11*a* arranged at the tops of the cassette supporters 10, 11 of the first cassette holder 2 contact the guide surface of the guide portions 45, 46 provided at the first ribbon cassette 14, respectively, to rotate the first ribbon cassette 14. The projections 8*a*, 9*a* arranged at the tops of the cassette supporters 8, 9 of the first cassette holder 2 are engaged with the projections 43, 44 provided on the first ribbon cassette 14, respectively. Since the ink ribbon faces the printing face of the print head in this condition, the black ink can be imprinted if the printer operates.

When the multicolor ink ribbon is used, the first ribbon cassette 14 is detached from the first cassette holder 2, and then, the second ribbon cassette 18 is attached to the liftable holder 19 of the second cassette holder 3. The liftable holder 19 moves up and down by the ribbon shifting mechanism provided on the fixed holder 17 with respect to the printing face of the print head.

It is to be noted that when the monochrome ink ribbon is used, the second cassette holder 3 can be detached from the first cassette holder 2. To detach it, levers 24*a*, 24*b* of the fixed holder 17 are sandwiched by fingers, so that the first latch members 22*a*, 22*b*, 22*c*, 22*d* are bent outward to disengage the hooks being engaged with the side walls 15*a*, 15*b* of the first cassette holder 2, while the projections 12, 13 of the first cassette holder 2, which are contacting the centers of the levers 24*a*, 24*b*, serve as fulcrums. Then, the second cassette holder 3 is slidably removed from the first cassette holder 2, while slid.

Referring to FIG. 13, the homing operation of the color ribbon will be described below. If it is assumed that a color ribbon, for example, yellow had been used in the previous use when the printer was turned off, in the current use, the yellow color ribbon must correspond to the printing face of the print head when the printer is turned on. Therefore, the detent spring 81 engages the dimple 77 of the cam gear 70, thereby corresponding the gear teeth of the change gear 65 to the range E of the cam gear 70.

At time t1, the control unit 200 turns on the spacing motor 5, thereby flowing current amplified by a driver not shown to the spacing motor 5. The spacing motor 5 is rotated in a reverse direction, or a direction for lowering the liftable holder 19, and drives to rotate the drive gear 61 as well as the change gear 65.

The control unit 200 outputs a signal of one pulse to the electromagnet 82 at time t2. The current amplified by a driver not shown flows through the electromagnet 82, thereby exciting the electromagnet 82 to attract the armature 93 in opposition to elastic force of the set spring 83. The change gear 65 is pushed down until the side face 98 contacts the side face 86 of the cam gear 70, and then, the gear teeth of the change gear 65 mesh the gear teeth beneath the range E, the partial tooth portion, of the cam gear 70 to rotate the cam gear 70 in direction L shown by an arrow in FIG. 7.

At time t3, the electromagnet 82 is demagnetized, and the armature 93 separates from the core 92 by the reset spring 83 as shown in FIG. 8. The one arm 91 of the reset spring 83 contacts the circumference of the small disc 68 of the change gear 65. Meanwhile, the side face 98 of the change gear 65 moves up along the upwardly slanting surface of the angle boss 85 arranged on the side face 86 of the cam gear 70 in opposition to elastic force of the set spring 84. When the change gear 65 reaches the top of the angle boss 85, the side face 98 of the change gear 65 rides on the one arm 91 of the reset spring 83, so that the gear 65 will be supported between the set spring 84 and the reset spring 83.

The gear teeth of the change gear 65 reach the partial tooth portion D of the cam gear 70 at time t4, and the detent spring 81 engages to the dimple 76 of the cam gear 70. Consequently, a color ribbon of magenta corresponds to the printing face of the print head. During this operation, although the drive gear 61 and the change gear 65 continue to rotate, since the cam gear 70 stops rotating, the cam shaft 31 and the liftable holder 19 are stopped also.

At time t5, the control unit 200 outputs a signal of one pulse to the electromagnet 82. The electromagnet 82 is excited and attracts the armature 93. Then, the cassette holder assembly repeats the operations described above, so that the gear teeth of the change gear 65 reach the partial tooth portion C of the cam gear 70 and that the detent spring 81 engages to the dimple 79 of the cam gear 70. As a result, a color ribbon of cyan corresponds to the printing face of the print head.

At time t6, the control unit 200 outputs a signal of one pulse to the electromagnet 82. By the similar operations, the gear teeth of the change gear 65 reach the partial tooth portion B of the cam gear 70, and the detent spring 81 engages to the dimple 78 of the cam gear 70. Consequently, a color ribbon of black corresponds to the printing face of the print head.

The control unit 200 outputs a signal of one pulse to the electromagnet 82 at time t7. The gear teeth of the change gear 65 mesh a part of the gear teeth of the cam gear, provided below the toothless portion in the partial tooth portion B, but the change gear 65 then idles because no tooth portion comes next on the way of the change gear 65.

At time 18, the control unit 200 stops the rotation of the spacing motor 5, and then, at time t9, makes the spacing motor 5 to rotate in a forward direction, or a lifting direction of the liftable holder 19. During this operation, the change gear 65 is in mesh with the cam gear 70, and the drive gear 61 rotates the cam gear 70 in the K direction shown by an arrow in FIG. 7 through the change gear 65. The gear teeth of the change gear 65 reach the partial tooth portion C of the cam gear 70 at time 10. At that time, a color ribbon of cyan corresponds to the printing face of the print head.

At time t11, the control unit 200 stops the rotation of the spacing motor 5, and then, at time t12, makes the spacing motor 5 to rotate in the reverse direction.

At time t13, the control unit 200 outputs a signal of one pulse to the electromagnet 82. Then, through the operations described above, the gear teeth of the change gear 65 correspond to the partial tooth portion B of the cam gear 70. When the gear teeth of the change gear 65 reach the partial tooth portion B of the cam gear 70, the detent spring 81 engages the dimple 78 of the cam gear 70, so that the a color ribbon of black corresponds to the printing face of the print head again. This is the end of the homing operation as an example. Selection of the color ribbon during printing is made by the control unit 200 through its program.

Although in this embodiment, the homing operation is started with yellow position, if the same operation is started with magenta, cyan, or black position, the change gear 65 idles for two, three, or four times at the black position for black, and then the operating position returns to the black position through the cyan position.

It is understood that although the present invention has been described in detail with respect to preferred embodiments thereof, various other embodiments and variations are possible to those skilled in the art which fall within the scope and spirit of the invention, and such other embodiments and variations are intended to be covered by the following claims.

What is claimed is:

1. A cassette holder assembly for a printer, said assembly comprising:

a first cassette holder having a face and means for detachable holding a first ink ribbon cassette on a printer at a predetermined height relative to said face;

a second cassette holder for holding a second ink ribbon cassette on the printer, the second ink ribbon cassette including a plurality of vertically superimposed ink ribbon layers; and means for detachably attaching said second cassette holder to said first cassette holder when no ink ribbon cassette is held by said first cassette holder;

said second cassette holder including means for adjusting a height of the second ink ribbon cassette relative to said face so as to selectively position the superimposed ink ribbon layers at said predetermined height, when said second cassette holder is attached to said first cassette holder.

2. A cassette holder assembly for alternatively holding a first ink ribbon cassette or a second ink ribbon cassette on a printer, the printer having a print head, the first and second ink ribbon cassettes each having an ink ribbon, said assembly comprising a first cassette holder for detachable holding the first ink ribbon cassette on a printer with its ink ribbon at a predetermined height relative to said face, opposing the print head;

a second cassette holder for holding the second ink ribbon cassette, the second ink ribbon cassette including a plurality of vertically superimposed ink ribbon layers; and means for detachably attaching said second cassette holder to said first cassette holder when no ink ribbon cassette is held by said first cassette holder;

said second cassette holder including means for adjusting a height of the second ink ribbon cassette relative to said face so as to selectively position the superimposed ink ribbon layers at said predetermined height, when said second cassette holder is attached to said first cassette holder, so that a selected ink ribbon layer of the second ink ribbon cassette opposes the print head.

3. A cassette holder assembly for alternatively holding a first ink ribbon cassette or a second ink ribbon cassette on a printer, the printer having a print head, the first and second ink ribbon cassettes each having an ink ribbon, said assembly comprising:

a first cassette holder for detachable holding the first ink ribbon cassette on a printer with its ink ribbon opposing the print head, said first cassette holder including a body and a plurality of cassette support members on said body, first ends of said members fixed to said body, said second ends of said members opposite said first ends having cassette attaching portions adapted to detachably attach the first ink ribbon cassette thereto, said first cassette holder further comprising a ribbon drive mechanism for driving the ink ribbon of the first ink ribbon cassette;

a second cassette holder for holding the second ink ribbon cassette; and means for detachably attaching said second cassette holder to said first cassette holder when no ink ribbon cassette is held by said first cassette holder, said detachably attaching means attaching said second cassette holder to said first cassette holder so that the ink ribbon of the second ink ribbon cassette opposes the print head.

4. A cassette holder assembly for alternatively holding a first ink ribbon cassette containing a monochrome ink ribbon, or a second ink ribbon cassette containing a multicolor ink ribbon, on a printer, the printer having a print head, said assembly comprising a first cassette holder for detachable holding the first ink ribbon cassette on the printer with its monochrome ink ribbon opposing the print head, said first cassette holder including a body, and a plurality of cassette support members on said body, first ends of said members fixed to said body, second ends of said members opposite said first ends having cassette attaching portions adapted to detachably attach the first ink ribbon cassette thereto;

a second cassette holder for holding the second ink ribbon cassette, said second cassette holder removably mounted on said first cassette holder while no ink ribbon cassette is held by said first cassette holder, said second cassette holder including:

a fixed holder having a ribbon shifting mechanism, a liftable holder on said fixed holder, having means for detachably attaching thereto the second ink ribbon cassette, said fixed holder and said liftable holder having holes penetrated by said cassette supporting members, and means for moving said liftable holder vertically with respect to said fixed holder so as to shift a vertical position of the multicolor ink ribbon contained the second ink ribbon cassette; and a ribbon drive mechanism for alternatively driving the monochrome ink ribbon in the first ink ribbon cassette when the first ink ribbon cassette is held by said first cassette holder, or driving the multicolor ink ribbon when the second ink ribbon cassette is held by said second cassette holder and said second cassette holder is mounted on said first cassette holder.

5. A cassette holder assembly according to claim 4, further comprising detachably attaching means for detachably attaching said second cassette holder to said first cassette holder when no ink ribbon cassette is held by said first cassette holder, said detachably attaching means including projections formed on respective opposite side walls of said body, pairs of latches formed on respective opposite side walls of said fixed holder so as to engage said opposite side walls of said body, and levers respectively connected said pairs of latches and contacting said projections such that each projection functions as a fulcrum.

6. A cassette holder assembly according to claim 4, wherein said liftable holder moving means includes first and second engaging threads;

a shift mechanism bearing said first thread;

a rotation mechanism mounted on said fixed holder for rotating said first shift mechanism, said shaft mechanism and said second thread being connected to said liftable holder and said fixed holder, such that rotation of said shift mechanism by said rotation mechanism moves said liftable holder vertically; and a parallel link mechanism for maintaining liftable holder and said fixed holder in a parallel relation.

7. A cassette holder assembly according to claim 6, wherein said fixed holder and liftable holder have side walls, said parallel link mechanism including a pair of links rotatably connected to each other at respective centers thereof, said links having first ends rotatably connected to the respective side walls of said fixed holder and said liftable holder, said links having second ends opposite said first ends slidably connected to said respective side walls.

8. A cassette holder assembly according to claim 7, wherein the side walls connected to said links are parallel to each other, said side walls having holes and horizontally extending slots, said first ends of said links rotatably mounted in said holes, said second ends of said links slidably mounted in said slots.

9. A cassette holder assembly according to claim 6, wherein said shift mechanism includes a cam shaft mounted on said fixed holder, said first thread comprising a helical groove in said cam shaft, said second thread comprising a projection on said liftable holder engaging said helical groove.

10. A cassette holder assembly according to claim 6, wherein said rotation mechanism includes a drive gear, a first gear rotatable together with said shift mechanism, and an intermittent rotator, disposed between said drive gear and said first gear, for intermittently rotating said first gear based on rotation of said drive gear, by incremental amounts corresponding to shift operations on the multicolor ink ribbon.

11. A cassette holder assembly according to claim 8, wherein said intermittent rotator includes a gear shaft on said fixed holder;

a second gear rotatably supported on said gear shaft and axially slidable on said gear shaft, said second gear meshing with said drive gear;

a unitary gear member, including a third gear having a circumference and a side surface, said third gear having a toothless portion and operative tooth portions, said operative tooth portions corresponding to the respective shift operations on the multicolor ink ribbon, each operative tooth portion including a partial tooth portion and a complete tooth portion, and a fourth gear coaxially aligned with said third gear and having a side surface covering the side surface of said third gear, said fourth gear meshing with said first gear;

a clutch portion for meshing said second gear with said operative tooth portions of said third gear; and means for leading said second gear, on a slant relative to said third gear, from said complete tooth portion to said partial tooth portion.

12. A cassette holder assembly according to claim 11, wherein said partial tooth portion contains teeth extending vertically upward from a first level of said third gear to a second level thereof, said complete tooth portion including teeth extending from said first level vertically upward to above said second level.

13. A cassette holder assembly according to claim 11, wherein said means for leading comprises a plurality of bosses on said side surface of said fourth gear, each boss having a slanting surface that engages said second gear to raise said second gear as said third gear rotates while said second gear is meshed with the teeth of said complete tooth portion, said clutch portion including:

an electromagnet, an armature attracted to said electromagnet, a first spring for urging said second gear to engage said third gear, and a second spring for disengaging said armature from said electromagnet and, in association with said first spring, supporting said second gear when contact between second gear and said slanting surface reaches a top end of said slanting surface.

14. A cassette holder assembly according to claim 13, wherein:

said partial tooth portion contains teeth extending vertically upward from a first level of said third gear to a second level thereof, said complete tooth portion including teeth extending from said first level vertically upward to above said second level, the teeth of the partial tooth portions disposed between said bosses so that, when said second gear is supported by said second spring and said second gear opposes said partial tooth portion, the teeth of said second gear are above and disengaged from the teeth of said partial tooth portion, whereby said unitary gear, and thus said first gear and said cam shaft, are not rotated with rotation of said second gear, and actuation of said electromagnet to attract said second spring withdrawing support of said second gear by said second spring, so that said second gear is lowered into engagement with the teeth of said partial tooth portion, whereby rotation of said second gear drives said unitary gear and thus said first gear and cam shaft.

15. A cassette holder assembly for a printer, said assembly comprising:

a first cassette holder having a face and means for detachable holding a first ink ribbon cassette on a printer so that the first ink ribbon cassette occupies a predetermined space above said face;

a second cassette holder for holding a second ink ribbon cassette; and means for detachably attaching said second cassette holder to said first cassette holder when no ink ribbon cassette is held by said first cassette holder;

said second cassette holder including means for adjusting a height of the second ink ribbon cassette relative to said face when said second cassette holder is attached to said first cassette holder, so as to selectively position the second ink ribbon cassette in said predetermined space.

16. A cassette holder assembly according to claim 15, wherein the second ink ribbon cassette includes a plurality of superimposed ink ribbon layers and said means for adjusting selectively positions the superimposed ink ribbon layers in said predetermined space.

17. A cassette holder assembly according to claim 15, wherein said second cassette holder includes a fixed holder detachably mounted on said face by said detachably attaching means, and a liftable holder on said fixed holder, said liftable holder for retaining the second ink ribbon cassette therein, said height adjusting means comprising means for lifting and lowering said liftable holder relative to said fixed holder.

* * * * *